US005433796A

United States Patent [19]

Isobe et al.

[11] Patent Number: 5,433,796

[45] Date of Patent: Jul. 18, 1995

[54] METHOD FOR PREPARING GALVANIZED STEEL STRIP HAVING MINIMAL UNCOATED DEFECTS

[75] Inventors: Makoto Isobe; Akira Yasuda; Koji Yamato, all of Chiba, Japan

[73] Assignee: Kawasaki Steel Corporation, Hyogo, Japan

[21] Appl. No.: 94,193

[22] Filed: Aug. 2, 1993

[30] Foreign Application Priority Data

Dec. 6, 1991 [JP] Japan ..... 3-322885

[51] Int. Cl.[6] ..... C23C 8/22

[52] U.S. Cl. ..... 148/220; 148/233; 427/433

[58] Field of Search ..... 148/220, 233, 319; 427/299, 433

[56] References Cited

U.S. PATENT DOCUMENTS

| | | | |
|---|---|---|---|
| 1,501,887 | 7/1924 | Crapo | 148/220 |
| 1,726,652 | 9/1929 | Crapo | 148/220 |
| 2,118,758 | 5/1938 | Crapo | 148/220 |
| 5,133,815 | 7/1992 | Hashimoto et al. | 148/319 |

FOREIGN PATENT DOCUMENTS

| | | |
|---|---|---|
| 0444967 | 4/1991 | European Pat. Off. . |
| 7-1725 | 5/1932 | Japan . |
| 55-122820 | 9/1980 | Japan . |
| 60-58305 | 12/1985 | Japan . |
| 63-149321 | 6/1988 | Japan . |
| 2-194156 | 7/1990 | Japan . |
| 3-199344 | 8/1991 | Japan . |
| 4-66620 | 3/1992 | Japan . |
| 4-276027 | 10/1992 | Japan . |

*Primary Examiner*—George Wyszomierski
*Attorney, Agent, or Firm*—Dvorak and Traub

[57] ABSTRACT

In the preparation of a galvanized steel strip by continuously heating and anneal reducing a steel strip and subsequently admitting it, without contact with the ambient air, into a molten zinc bath to coat the strip with zinc, there is provided a method for preparing a galvanized or galvannealed steel strip having minimal uncoated defects, characterized in that a steel strip having a composition which contains up to 0.1% by weight of C,
0.01 to 1.0% by weight of Si,
0.05 to 2.0% by weight of Mn, and
up to 0.15% by weight of P, and satisfies the following formula (1):

$$Si/28+Mn/55+P/31 \geqq 0.01 \quad (1)$$

wherein the element symbols represent the contents in % by weight of the respective elements in the steel strip is used as the starting strip to be galvanized, and the steel strip is subjected to carburizing treatment during the anneal reducing step or before the anneal reduced steel strip is admitted into the molten zinc bath.

4 Claims, No Drawings

METHOD FOR PREPARING GALVANIZED STEEL STRIP HAVING MINIMAL UNCOATED DEFECTS

FIELD OF THE INVENTION

This invention relates to methods for preparing galvanized and galvannealed steel strips for use as building materials such as roofing and wall materials and automotive bodies.

BACKGROUND OF THE INVENTION

In these years, there is an increasing demand for improving the corrosion resistance of building materials for accommodating the acidifying atmospheric environment and construction works on the shore or in the sea. For automotive bodies, on the other hand, corrosion resistance in snow melting salt spreading areas and seaside areas is a problem. One economically advantageous measure for improving corrosion resistance is zinc coating, especially zinc hot dipping or galvanizing. Further heat treatment to convert the zinc coating into a Fe-Zn alloy can improve weldability and corrosion resistance after paint coating. As the problem of global greenhouse effect has drawn great attention, discussions are made on energy savings, especially fuel consumption improvement and body weight reduction of automobiles. One effective approach is to increase the strength of steel strips. Galvanizing or galvannealing of high-strength steel strips is then required in order to meet the above-mentioned demand for corrosion resistance.

Galvanized or zinc hot dipped steel strips are manufactured by means of a continuous galvanizing line (CGL) by continuously carrying out the steps of degreasing by burning off of rolling grease or with alkali, annealing reduction, cooling, molten zinc bath dipping, and coating weight adjustment by gas wiping. Galvannealing or alloying is generally carried out immediately after the wiping step. As is well known in the art, readily workable high-strength steel strips contain Si, Mn, P, etc. as additive components, which tend to concentrate and be oxidized at the steel strip surface, which substantially detracts from wettability to molten zinc, eventually leading to uncoated defects. As a solution to this problem, it was proposed to carry out electroplating of Ni systems (JP-A 262950/1985 and 147865/1986) or electroplating of Fe systems (JP-A 194156/1990) to restrain concentration and oxidation of the additive components at the steel strip surface prior to the entry of steel strip into the CGL.

Electroplating of Ni systems or electroplating of Fe systems prior to the entry of steel strip into the CGL is effective for restraining concentration and oxidation of the additive components at the steel strip surface and thus enables galvanizing of high-strength steel strips containing Si, Mn, P, etc., but with the accompanying problems of more complex process, higher cost, and lower productivity due to the installation of an additional electroplating equipment. It is then desired to develop a method capable of galvanizing high-strength steel strips containing Si, Mn, P, etc. without raising these problems.

DISCLOSURE OF THE INVENTION

Therefore, an object of the present invention is to provide an economical method for galvanizing or galvannealing high-strength steel strips containing Si, Mn, P, etc. without generating uncoated defects.

Making extensive investigations on a method capable of galvanizing high-strength steel strips containing Si, Mn, P, etc. with the existing galvanizing apparatus unchanged and without pretreatment by electroplating, the inventors have found that by further forming a carbon concentrated layer at the surface where the additive elements have concentrated, the surface can be activated to ensure wettability to molten zinc.

Accordingly, the present invention provides a method for preparing a galvanized or galvannealed steel strip having minimal uncoated defects by continuously heating and anneal reducing a steel strip and subsequently admitting it, without contact with the ambient air, into a molten zinc bath to coat the strip with zinc, characterized in that a steel strip having a composition which contains up to 0.1% by weight of C,
0.01 to 1.0% by weight of Si,
0.05 to 2.0% by weight of Mn, and
up to 0.15% by weight of P, and satisfies the following formula (1):

$$Si/28+Mn/55+P/31 \geqq 0.01 \quad (1)$$

wherein the element symbols represent the contents in % by weight of the respective elements in the steel strip is used as the starting strip to be galvanized, and the steel strip is subjected to carburizing treatment during the anneal reducing step or before the anneal reduced steel strip is admitted into the molten zinc bath. It is especially preferred that the carburizing treatment be carried out after annealing.

THE BEST MODE FOR CARRYING OUT THE INVENTION

The present invention is described below in detail.

The present invention permits high-strength steel strips which are readily workable due to the inclusion of Si, Mn, P, etc. to be galvanized without preliminary plating of a nickel or iron system, by subjecting the steel strips to carburizing treatment during the anneal reducing step or before the anneal reduced steel strips are admitted into a molten zinc bath. Thus the steel strips used herein should contain the following components.

C: Carbon is an element which directly governs the strength of steel strips and largely affects workability. Since the object of the invention is to provide a readily workable galvanized high-strength steel strip, the upper limit of carbon content is generally 0.1% by weight in consideration of workability and preferably up to 0.02% by weight for better workability.

Si: Silicon is an element which is effective for increasing steel strip strength while maintaining good workability. It is effective when added in amounts of at least 0.01%, preferably at least 0.05% by weight. Since silicon, however, tends to concentrate at the surface and detract from coating wettability, the silicon content is preferably up to 1.0% by weight in order to ensure coating wettability in the practice of the galvanizing method of the invention.

Mn: Like silicon, manganese is effective for increasing steel strip strength while maintaining relatively good workability and is preferably added in amounts of at least 0.05% by weight. However, addition of more than 2.0% by weight of manganese is rather undesirable because of difficulty of melting, increased cost, and reduced coating wettability due to surface concentration as found with silicon.

P: Phosphorus is an incidental impurity and may be present to the upper limit of 0.15% by weight since it is effective for strength increase like silicon and manganese.

The steel strips to which the present invention pertains are further limited to those in which the contents represented in % by weight of respective elements Si, Mn, and P satisfy the following formula.

$$1/28 \bullet Si + 1/55 \bullet Mn + 1/31 \bullet P \geqq 0.01$$

This is because the steel strips within this range are very likely to develop uncoated defects or undergo non-uniform burning on alloying treatment.

Cr, Cu, Ni, Mo: These elements do not directly deal in the preparation of readily workable high-strength steel strips as intended by the present invention, but are effective for improving the corrosion resistance of base steel strips after losing the rust preventing effect of coatings. Therefore, they may be added up to the upper limits of 2.0%, 3.0%, 2.0% and 1.0% by weight, respectively, depending on necessity. Addition of these elements in excess of the limits undesirably detracts from coating receptivity and adds to cost.

Ti, Nb: These elements are effective for improving workability by reducing carbon solid solution and may be added up to the upper limits of 0.3% and 0.2% by weight, respectively, depending on the carbon content. Addition of these elements in excess of the limits is undesirable because of increased cost, but desirable where it is effective and necessary to reduce the carbon content.

In order to galvanize the above-mentioned steel strip through the CGL without uncoated defects, the following procedure is necessary.

The steel strip which has a controlled gage as a result of cold or hot rolling is first subjected to surface cleaning, degreasing and optional descaling at the CGL inlet. The steel strip which has been hot rolled, descaled and then cold rolled is most preferably subjected to degreasing and pickling at the CGL inlet, but degreasing may be replaced by burning off within the line. In this case, however, in order to minimize oxidation of the steel strip and to restrain concentration of the additive components at the surface, burning is carried out at an air-fuel ratio of less than unity (NOF operation) and at 550° C. or lower. On the other hand, a hot rolled steel strip must be descaled until it reaches the CGL inlet since it has much oxide on the surface.

Subsequently, the strip is anneal reduced at a temperature of 700 to 950° C. depending on the required material structure and cooled at a predetermined rate before it is admitted into a molten zinc bath. During or after this anneal reducing step, the steel strip is subjected to a carburizing treatment in a mixture of a reducing gas and a carburizing gas as a carbon source in order to form a carbon concentrated layer at the steel strip surface. As the carburizing gas serving as a carbon source, carbon monoxide is most commonly used and easy to handle although hydrocarbons such as methane, ethers, aldehydes and alcohols may also be used. The carburizing treatment may be done during the anneal reducing step or during cooling after the anneal reducing step although introduction of a carbon source gas is preferably started at a temperature of at least 650° C. Especially when it is desired to establish a predetermined carbon concentration only in a surface layer, the carburizing treatment is preferably done during cooling after annealing. The carbon source gas may be introduced in a concentration of 2 to 20%. Less than 2% of the carbon source gas would fail to establish a sufficient carbon concentration (a carbon concentration of at least 0.1% by weight is necessary when averaged over a surface layer corresponding to a grain size of 30 μm) to prevent a loss of coating receptivity caused by oxides of Si and the like.

The steel strip which has been anneal reduced and carburized is directly admitted into a molten zinc bath, which may be at a conventional temperature of about 450 to 490° C. while the strip upon dipping may be at a temperature of about 380 to 550° C. The bath may be of a conventional composition, and its aluminum concentration is preferably at least 0.1% by weight if zinc dipping is not followed by alloying, or up to 0.3% by weight, more preferably 0.10 to 0.20% by weight if alloying follows. For improving corrosion resistance, elements such as magnesium may be added with lead being preferably up to 0.1% by weight.

Dipping in the molten zinc bath is followed by wiping for adjusting the coating weight and then by optional alloying treatment, obtaining a galvanized or galvannealed steel strip.

EXAMPLE

Examples of the present invention are described below.

Example

A vertical CGL simulator was used as the galvanizing apparatus. Nitrogen containing 5% of hydrogen was used as the annealing/reducing gas. For carburizing, Examples 1–9 added 2% of CO, Example 10 added 18% of CO, and Example 11 added 1.2% of CO to the annealing/reducing gas. The bath used was a molten zinc bath containing 0.15% by weight of Al and 0.005% by weight of Pb at 470° C. Test steel strips of the composition shown in Table 1 were previously cold rolled to a gage of 0.7 mm, electrolytically degreased and pickled with hydrochloric acid. Table 1 shows the components of the test steel strips and Table 2 shows the conditions of annealing reduction, carburizing treatment and galvanizing as well as ratings. Evaluation of coating receptivity or uncoated defects is based on the criterion shown in Table 3.

As seen from Table 2, steel strips galvanized according to the present invention are satisfactory galvanized or galvannealed steel strips free of uncoated defects.

TABLE 1

| | Chemical components of test steel strips | | | | | | | | | | | | |
|---|---|---|---|---|---|---|---|---|---|---|---|---|---|
| Type | C | Si | Mn | P | S | Cr | Cu | Ni | Mo | Ti | Nb | X | Class |
| A | 0.022 | 0.53 | 0.45 | 0.052 | 0.001 | — | — | — | — | — | — | 0.02879 | Invention |
| B | 0.072 | 0.10 | 1.72 | 0.095 | 0.001 | — | — | — | — | — | — | 0.03791 | Invention |
| C | 0.0031 | 0.14 | 0.45 | 0.041 | 0.001 | 0.44 | 0.04 | 0.10 | 0.22 | — | — | 0.01450 | Invention |
| D | 0.0025 | 0.22 | 0.98 | 0.046 | 0.001 | — | — | — | — | 0.12 | 0.028 | 0.02716 | Invention |

TABLE 1-continued

| Type | C | Si | Mn | P | S | Cr | Cu | Ni | Mo | Ti | Nb | X | Class |
|---|---|---|---|---|---|---|---|---|---|---|---|---|---|
| | Chemical components of test steel strips | | | | | | | | | | | | |
| E | 0.025 | 1.24 | 1.22 | 0.030 | 0.001 | 0.10 | — | 0.05 | — | — | — | 0.06744 | Comparison |

X = Si/28 + Mn/55 + P/31

TABLE 2

| Sample No. | Steel Type | Annealing reduction Heating-Holding-Cooling | Carburizing treatment Start-End | Carburizing atmosphere CO (%) | Galvanizing Strip temp.-Time | Alloying Temp.-Time | Evaluation | Class | Average C concentration in surface layer*1 (%) |
|---|---|---|---|---|---|---|---|---|---|
| | | Annealing conditions, carburizing conditions, galvanizing conditions, and evaluation of coating receptivity | | | | | | | |
| 1 | A | 15° C./s, 850° C.-20 s, −15° C./s | 700° C.-550° C. | 2 | 490° C.-3 s | none | ○ | Invention | 0.13 |
| 2 | A | 15° C./s, 850° C.-20 s, −15° C./s | 750° C.-650° C. | 2 | 490° C.-3 s | none | ○ | Invention | 0.11 |
| 3 | A | 15° C./s, 850° C.-20 s, −15° C./s | none | 2 | 490° C.-3 s | none | X | Comparison | 0.02 |
| 4 | A | 15° C./s, 850° C.-20 s, −15° C./s | 700° C.-550° C. | 2 | 490° C.-3 s | 500° C.-30 s | ○ | Invention | 0.13 |
| 5 | B | 15° C./s, 850° C.-20 s, −15° C./s | 700° C.-550° C. | 2 | 490° C.-3 s | none | ○ | Invention | 0.15 |
| 6 | C | 15° C./s, 850° C.-20 s, −15° C./s | 700° C.-550° C. | 2 | 490° C.-3 s | none | ○ | Invention | 0.12 |
| 7 | D | 15° C./s, 850° C.-20 s, −15° C./s | 700° C.-550° C. | 2 | 490° C.-3 s | none | ○ | Invention | 0.11 |
| 8 | E | 15° C./s, 850° C.-20 s, −15° C./s | 700° C.-550° C. | 2 | 490° C.-3 s | none | X | Comparison | 0.05 |
| 9 | E | 15° C./s, 850° C.-20 s, −15° C./s | 700° C.-550° C. | 2 | 490° C.-3 s | 500° C.-30 s | X | Comparison | 0.05 |
| 10 | A | 15° C./s, 880° C.-30 s, −10° C./s | 850° C.-780° C. *2 | 18 | 470° C.-3 s | 550° C.-20 s | ○ | Invention | 0.35 |
| 11 | A | 15° C./s, 880° C.-30 s, −10° C./s | 850° C.-780° C. | 1.2 | 470° C.-3 s | 550° C.-20 s | X | Comparison | 0.04 |

*1Average C concentration in a surface layer of 30 μm (thickness approximately equal to a grain size)
*2Cooling at 1° C./s during carburizing

TABLE 3

| Rating | Criterion for coating receptivity rating: Coating appearance |
|---|---|
| ○ | no uncoated defects |
| Δ | up to 5 uncoated defects with a diameter of up to 1 mm |
| X | some uncoated defects with a diameter of larger than 1 mm and more than 5 uncoated defects with a diameter of up to 1 mm |

INDUSTRIAL APPLICABILITY

The present invention permits high-strength steel strips containing Si, P, Mn, etc. to be galvanized or galvannealed without preliminary electroplating of an iron or nickel system, contributing to improved productivity and cost reduction.

We claim:

1. A method for preparing a galvanized steel strip having a carbon concentration of at least 0.1% by weight averaged over a surface layer of 30 μm in thickness, said thickness approximately equal to a grain size of said strip, the method comprising steps of:

continuously heating and annealing in a reducing atmosphere a steel strip having a composition which contains up to 0.1% by weight of C, 0.01 to 1.0% by weight of Si, 0.05 to 2.0% by weight of Mn, and up to 0.15% by weight of P, and satisfies the following formula (1):

$$Si/28+Mn/55+P/31 \geqq 0.0145$$

wherein the element symbols represent the contents in % by weight of the respective elements in the steel strip, as a starting strip to be galvanized;

subjecting the annealed steel strip to a carburizing treatment simultaneous to cooling after the annealing step, wherein the carburizing treatment is conducted by use of a carburizing gas with a 2 to 20% concentration in a reducing gas; and subsequently admitting the carburized steel strip, without contact with the ambient air, into a molten zinc bath to coat the strip with zinc thereby producing a galvanized steel strip having minimal uncoated areas.

2. A method for preparing a galvanized steel strip according to claim 1 wherein the steel strip further contains at least one member selected from the group consisting of Cr, Cu, Ni, Ti, Nb and Mo, wherein the Cr content is up to 2.0% by weight, the Cu content is up to 3.0% by weight, the Ni content is up to 2.0% by weight, the Ti content is up to 0.3% by weight, the Nb content is up to 0.2% by weight, and the Mo content is up to 1.0% by weight.

3. A method for preparing a galvannealed steel strip, comprising further subjecting the steel strip galvanized by the method of claim 1 to heating for alloying the zinc coating.

4. A method for preparing a galvannealed steel strip, comprising further subjecting the steel strip galvanized by the method of claim 2 to heating for alloying the zinc coating.

* * * * *